United States Patent [19]

Tsukiyama et al.

[11] Patent Number: 4,622,826

[45] Date of Patent: Nov. 18, 1986

[54] CONTROL CIRCUIT FOR AN AUGER TYPE ICE MAKER

[75] Inventors: Yasumitsu Tsukiyama, Toyoake; Yoshikazu Kito, Oobu; Junichi Hida, Chiryu; Susumu Tatematsu, Nagoya, all of Japan

[73] Assignee: Hoshizaki Electric Co., Ltd., Aichi, Japan

[21] Appl. No.: 759,438

[22] Filed: Jul. 26, 1985

[51] Int. Cl.[4] ..... F25C 1/00

[52] U.S. Cl. ..... 62/137; 62/182; 62/233

[58] Field of Search ..... 62/233, 157, 158, 137, 62/135, 138, 180, 182

[56] References Cited

U.S. PATENT DOCUMENTS

| | | | |
|---|---|---|---|
| 2,706,385 | 4/1955 | Topping | 62/158 X |
| 2,961,842 | 11/1960 | Wright | 62/137 |
| 2,962,877 | 12/1960 | Chaplik et al. | 62/137 X |
| 3,365,901 | 1/1968 | Guard | 62/137 |
| 3,511,059 | 5/1970 | Hoenisch | 62/138 |

FOREIGN PATENT DOCUMENTS 59-38698 10/1984 Japan .

*Primary Examiner*—Harry Tanner

*Attorney, Agent, or Firm*—Wenderoth, Lind & Ponack

[57] ABSTRACT

A control circuit for an auger type ice maker using a relay which is responsive to a predetermined level of an ice making water in a tank and to of a predetermined level of stored ice, and a timer circuit responsive to the commencement of the ice making cycle which corresponds to the detection of the water level and the completion of the ice making cycle which corresponds to the detection of the ice level, both by the relay. This timer circuit is arranged so that during the starting operation it starts to drive the auger motor at the beginning of the ice making cycle and then after a first predetermined time starts to drive the compressor, and during the stopping operation, it stops the compressor after a second predetermined time after the detection of the completion of the ice making cycle and then after a third predetermined time stops the auger motor. Should a short interruption of the supply of water occur, the timer circuit can ignore it because of its delay time. A backup function is also provided for the case of an abnormal ice level of stored ice.

10 Claims, 4 Drawing Figures

CONTROL CIRCUIT FOR AN AUGER TYPE ICE MAKER

BACKGROUND OF THE INVENTION

This invention relates to an ice maker, and in particular to a control circuit for an auger type ice maker.

Such a control circuit that has been used heretofore is one as disclosed in the specification of the U.S. Pat. No. 3,365,901. According to this Patent, an ice making cycle is initiated upon the closure of an ice level detection switch which causes an auger motor which is also called a gear motor to start to operate and causes a thermally operated time delay switch to be energized. In a predetermined time delay due to the time delay switch, an ice maker compressor motor is energized. At the end of the ice making cycle, when the ice level detecting switch is operated to open, the ice maker compressor as well as the time delay switch are immediately deenergized while the auger motor continues to be run until the time delay switch returns to its cool position.

In this patent a stirring rod is provided which serves to prevent the possibilities of freeze-up in the ice storage hopper and to dispense a quantity of ice. Since this stirring rod is still rotating even though the ice storage hopper is filled with ice, the ice level switch may be re-opened, since the upper configuration of the ice stored within the hopper changes from convex and concave during stirring. Therefore, the ice level switch may be repeatedly closed and opened, so that the compressor is also repeatedly started and stopped in response to the above repeated operations of the ice level switch. Due to this repeated operations, the compressor is over-loaded and then a protector for the compressor may be operated, resulting in a shortening of the operating lifetimes of the compressor and the protector.

On the other hand, Japanese utility model Publication No. 59-38698 published on Oct. 27, 1984 of the same assignee as this patent application discloses the use of a thermal timer for the same control of such an auger motor and a compressor. This thermal timer has a drawback that a large variation of a delay time is produced depending on an ambient temperature and that a predetermined time delay may not be obtained due to the use of two thermal timers.

SUMMARY OF THE INVENTION

It is accordingly an object of the present invention to prevent an auger motor and a compressor of an ice making mechanism from being damaged due to various conditions such as the freeze-up of a refrigerated casing, the lack of ice making water, and the malfunction of an ice level detection switch.

In view of the above object, the present invention employs a relay which is energized and self-held by the detection of a level of an ice making water to stop supplying the water and which is deenergized by the detection of a level of stored ice, and a timer circuit responsive to the commencement of the ice making cycle which corresponds to the detection of the water level and the completion of the ice making cycle which corresponds to the detection of the ice level, both by the relay. This timer circuit is arranged so that it starts to drive the auger motor at the beginning of the ice making cycle and then after a first predetermined period of time starts to drive the compressor, and at the completion of the ice making cycle, it stops the compressor after a second predetermined period of time and then after a third predetermined period of time stops the auger motor.

Preferably, the detection of the water level is carried out by a water level switch having a noramlly open contact of an upwardly/downwardly floating type. The combination of the water level switch, the relay, an ice level switch carrying out the detection of an ice level, and a water valve allows an ice making operation to be continued regardless of the water interruption within a fixed short time interval. Upon the failure of the ice level switch, a different ice level switch may detect such a failure for the backup of the ice level switch and immediately stop the operations of the auger motor and the compressor through the timer circuit for precluding such an abnormal condition.

BRIEF DESCRIPTION OF THE DRAWINGS

Throughout the figures, the same reference numerals indicate identical or corresponding portions.

DETAILED DESCRIPTION OF THE PREFERRED EMBODIMENT

There will now be described in detail the present invention along preferred embodiments thereof illustrated in the accompanying drawings.

Figure 1:
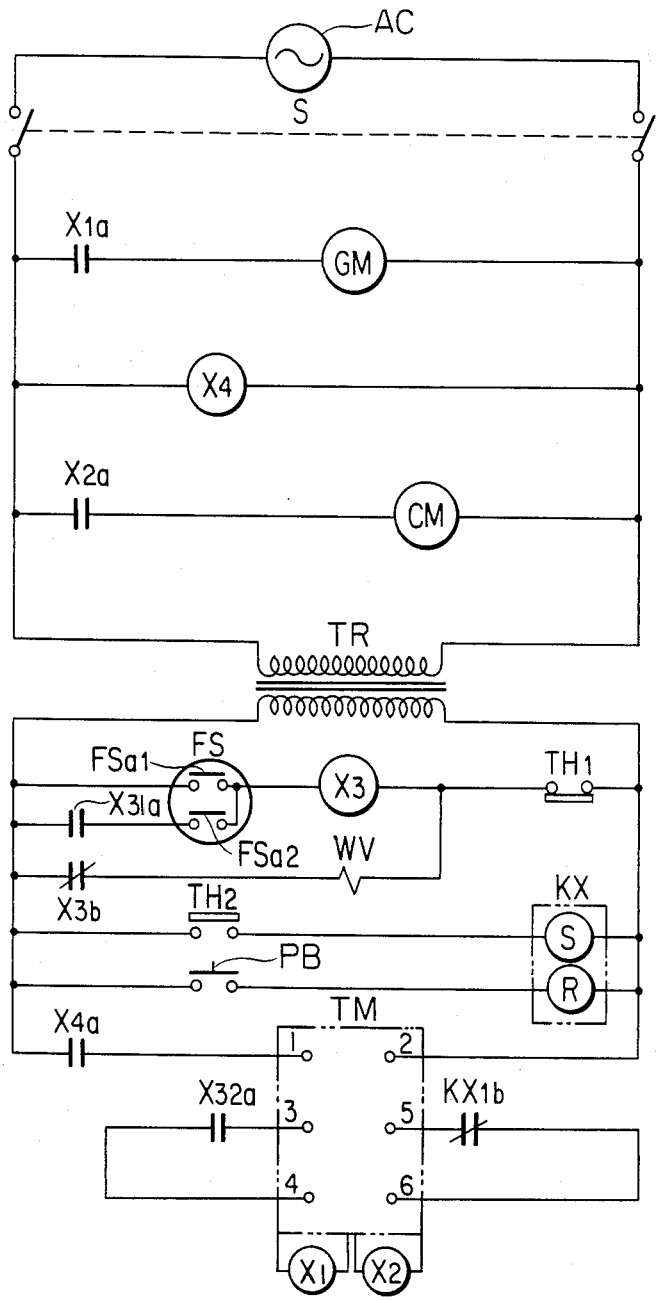
FIG. 1 shows a diagram of a control circuit for an auger type ice maker according to the present invention.

In FIG. 1 showing a control circuit of an auger type ice maker according to the present invention, across an alternating power source AC via a power source switch S, a transformer TR is connected. In the primary side of the transformer TR, an auger (gear) motor GM, a relay X4 and a compressor CM are provided while in the secondary side of the transformer TR, a water level switch FS, a water valve WV, ice level switches TH1 and TH2, an electronic timer circuit TM, relays X1–X4, and a keep-relay KX are provided, as shown in the FIG. 1. The water level switch FS has a floating normally open (hereinafter referred to as N.O.) contact FSa1 positioned at an upper level and a floating N.O. contact FSa2 positioned at a lower level. The ice level switch TH1 of a normally closed type (hereinafter referred to as N.C.) detects a normally stored quantity of ice, and the ice level switch TH2 of an N.O. type is positioned higher than the switch TH1 so that an abnormal ice storage condition may be detected when the ice level switch TH1 does not operate normally due to its failure or malfunction. The relay X1 has an N.O. contact X1*a* serially connected to the auger motor GM, the relay X2 has an N.O. contact X2*a* serially connected to the compressor CM, the relay X3 has an N.O. contact X31*a* serially connected to the contact FSa2, an N.O. contact X32*a* connected across terminals 3 and 4 of the timer TM, and an N.C. contact X3*b* serially connected to the water valve WV, and the relay X4 has an N.O. contact X4*a* connected to terminal 1 of the timer TM. The relay KX has an N.C. contact KX1*b* connected across terminals 5 and 6 of the timer TM and operates like an R-S flip-flop as shown by S and R in the block thereof respectively activated by the switch TH2 and a push button PB which are used respectively to set and reset the relay KX. The contact FSa1 is connected in parallel with the series combination of the contacts X31*a* and FS*a*2 and in series with the relay X3 and the switch TH1. The series combination of the contact X3*b* and the water valve WV is connected in parallel with the series combination of the contact FSa1 and the relay X3 and in series with the switch TH1. Terminals 1 and 2 of the timer TM are connected via the contact X4*a* across the secondary winding of the transformer TR.

Figure 2:
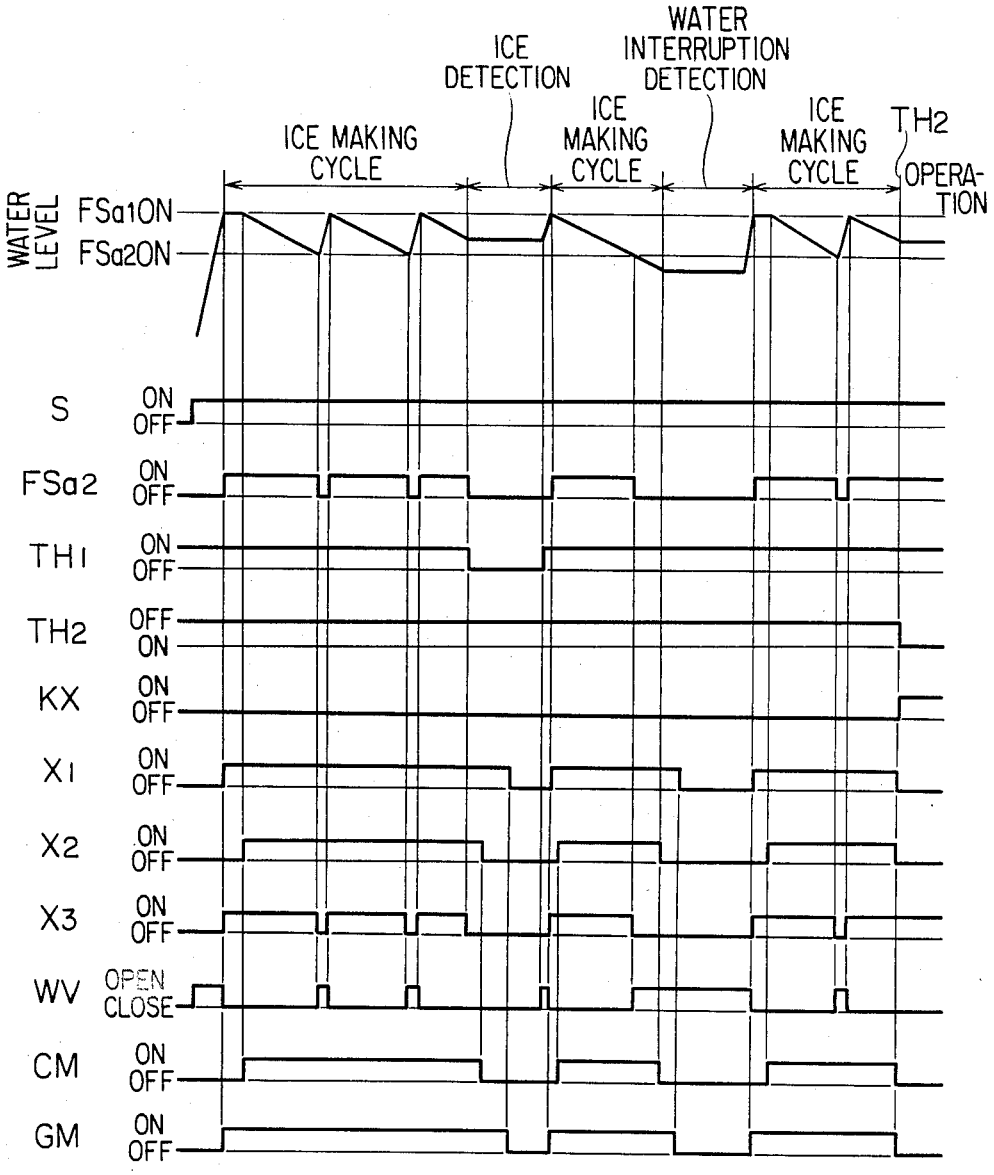
FIG. 2 shows a time chart of the control circuit shown in FIG. 1.

The operation of the control circuit shown in FIG. 1 will not be described referring to the time chart shown in FIG. 2.

When the power source switch S is closed, the water valve WV is energized to be opened through the N.C. contact X3*b* of the relay X3 and the ice level switch TH1 to supply water to a float tank (not shown). The relay X4 is also excited to close its N.O. contact X4*a* and to supply a source power to the timer circuit TM.

When the water level in the tank being supplied with water goes up to a prescribed upper level, the contacts FSa1 and FSa2 of the water level switch are both closed to excite the relay X3 which, in turn closes the N.O. contact X31*a*, so that the relay X3 is self-held and the water valve WV is deenergized due to the opening of the N.C. contact X3*b*, resulting in the stoppage of the water supply. Upon the excitation of the relay X3, i.e. at the beginning of an ice making cycle, the N.O. contact X32*a* is also closed so that the timer circuit TM initiates its timer operation which will be described later.

Figure 3:
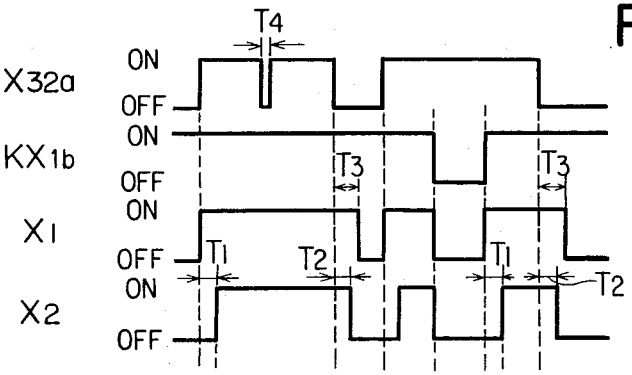
FIG. 3 shows a time chart in more detail of the time chart shown in FIG. 2 with reference to the operation of the timer circuit shown in FIG. 1; and, FIG. 4 shows a detailed arrangement of the timer circuit shown in FIG. 1.

The time chart of the timer circuit TM is shown in FIG. 3. Therefore, the description will be made by also referring to FIG. 3.

Almost concurrently with the closure of the N.O. contact X32*a*, the timer circuit TM excites the relay X1 combined therewith, and then, after a first period of time T1 excites the relay X2 also combined with the timer circuit TM (where T1=about 60 seconds). Upon the excitation of the relay X1, the auger motor GM is energized through the N.O. contact X1*a* to initiate the operation thereof while upon the excitation of the relay X2, the compressor CM is energized through the N.O. contact X2*a* to initiate the operation thereof, whereby the ice making cycle is started. It is to be noted that the combination of the timer circuit TM and the relays form a timer circuit means.

As the ice making process progresses the water in the tank is gradually consumed, i.e. being changed into ice so that the water level in the tank lowers, resulting in the opening of the floating N.O. contact FSa2 when the level thereof is lower than the switch FS. It is to be noted that at this time the floating N.O. contact FSa1 at the upper level is already open. Also at this time, the relay X3 is deenergized thereby to return the N.C. contact X3*b* to its closed state, resulting in the excitation or the re-opening of the water valve WV for the water supply. During the time interval (T4=10–20 seconds) for the supply of water, the relay X3 is in the deenergized state as mentioned above whereby the N.O. contact X32*a* is open. However, as shown in FIG. 3, since the time interval (T4) for the water supply is normally shorter than a time interval (T2=about 60 seconds) for delaying the operation of the relay X2, the excited state of the relays X1 and X2, that is the ice making state in which the auger motor GM and the compressor motor CM are driven is continued without any interruption even though such a water supply interval arises, thereby storing ice in a storage hopper (not shown).

When the stored ice touches the ice level switch TH1 at the predetermined level, which may comprise a thermo-switch, as the quantity of ice within the storage hopper increases, the ice level switch TH1 is opened to output an ice level detection signal. This causes the relay X3 to be deenergized and the N.O. contact X32*a* to be opened so that the timer circuit TM deenergizes the relay X2 after a fixed time interval (about 60 seconds) after the contact X32*a* is opened and then deenergizes the relay X1 after a further fixed time interval (about 60 seconds). The deenergization of the relay X2 stops the operation of the compressor while the deenergization of the relay X1 stops the operation of the auger motor GM. Therefore, the auger motor GM continues to operate for a fixed time interval even after the compressor CM has stopped to operate, so that the ice remaining in the refrigerated chamber or casing may be dispensed into an ice storage hopper (not shown), after which the auger motor GM is stopped, thereby preventing the refrigerated chamber from being frozen up. In this case, there may occur a case where the ice level switch TH1 is repeatedly switched on and off according to changes in the top surface conditions of ice. However, no repeated operation of the compressor CM due to the chattering of the switch TH1 arises, unless the time interval between the time interval of the switch-on and switch-off of the switch TH1 exceeds 60 seconds, whereby favourable operations as shown in FIG. 3 are realized.

Upon the closure of the ice level switch TH1 due to the consumption of ice stored, the relay X3 is excited to close the N.O. contact X32*a*, whereby along the same operation as described above with respect to the power source switch S being closed, the auger motor GM is immediately driven and then after a fixed time interval the compressor CM is driven. Therefore, the compressor CM is no longer over-loaded.

On the occurrence of the interruption of the water supply during the ice making cycle, likewise the case where the level of the ice making water goes below the lower level as above noted, the water level within the float tank goes low, thereby opening the floating N.O. contact FSa2 at the lower level. Consequently, the relay X3 is deenergized to open the N.O. contact X32*a* so that the timer circuit TM initiates its timer operation defined by predetermined time interval shown by T2 and T3 in FIG. 3. However, if at this time the relay X3 is not returned to its excited state before the above mentioned fixed time interval, namely, T2=about 60 seconds due to the water interruption, the timer circuit TM firstly deenergizes the relay X2 at the time when a fixed time interval (T2) of 60 seconds has lapsed to stop the operation of the compressor CM through the N.O. contact X2*a* and at the time when a further fixed time interval (T3) of 60 seconds has lapsed the timer circuit TM secondary deenergizes the relay X1 to stop the operation of the compressor GM through the N.O. contact X1*a*. Thus, it is possible to preclude the freezing up of the ice maker during the idling state thereof due to lack of water, and prevent a liquid coolant from being returned to the compressor CM due to the excessive reduction of the load.

On the other hand, because the relay X3 is in the deenergized state during the above mentioned state, the contact X3*b* is closed and the water valve WV is opened. Accordingly, when the water supply is re-opened, the water level starts moving up until it activates the switch FS, thereby automatically re-starting the ice making cycle.

Upon the detection of a predetermined ice level by the ice level switch TH1, or the detection of a predetermined water level by the water level switch FS, even though these switches TH1 and FS are actuated immediately, after the stoppage of the compressor CM thereby to excite the relay X3 to close the N.O. contact X32*a*, the timer circuit TM does not operate to allow the compressor CM to be re-opened before a fixed time interval (T2=about 60 seconds) has lapsed whereby an excessively repeated operation of the compressor CM and the freeze-up of the refrigerated chamber can be avoided because the auger motor GM is being driven without stopping for a further fixed time interval.

If the ice level switch TH1 fails so that the above noted detection of the ice level may not be carried out, ice will be stored up to the vicinity of the exit (not shown) of ice in the ice storage hopper. However, another switch that is the N.O. ice level switch TH2 is provided in order to detect and remove such an abnormal quantity of ice, so that by the closure of the switch TH2 the keep-relay KX is excited to open the N.C. contact KX1*b* whereby at about the same time the timer circuit TM works so that the relays X1 and X2 are deenergized as shown in FIG. 3 to immediately stop the ice making cycle, resulting in the prevention of a serious fault due to the too much ice in the ice maker. It is to be noted that the keep-relay KX can be reset by the push button PB.

Next, the timer circuit TM specifically shown in FIG. 4 will now be described along the time chart of FIG. 3.

Figure 4:
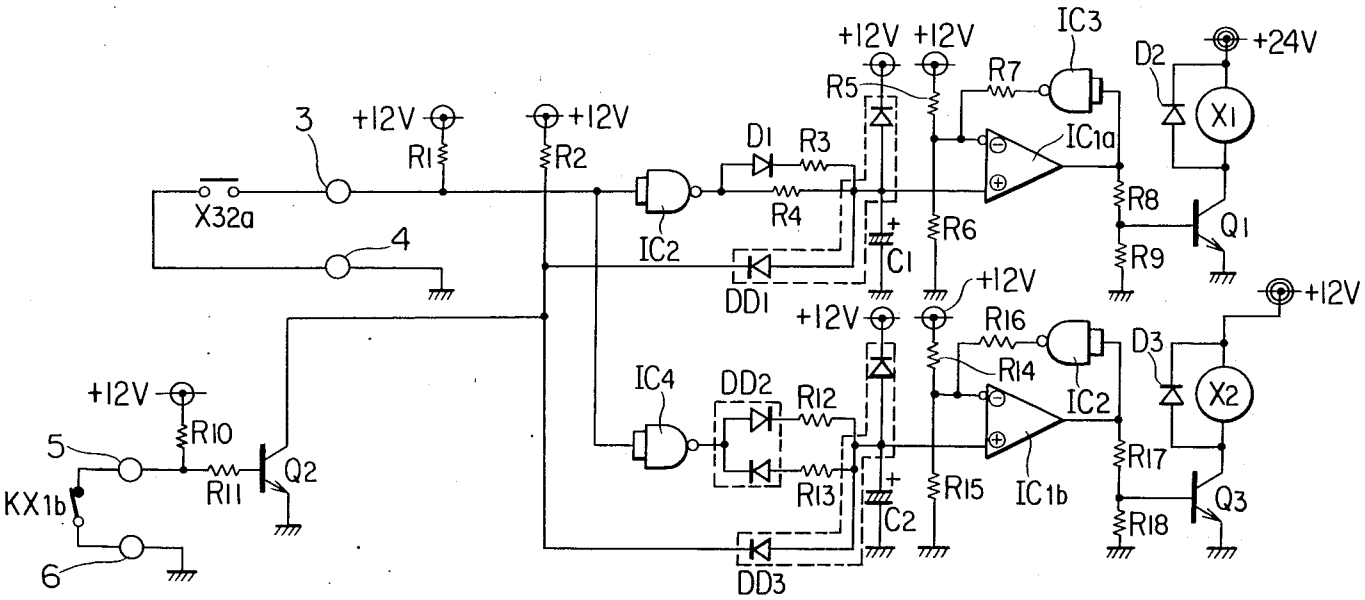

As shown in FIG. 4, the timer circuit TM includes transistors Q1–Q3, operational amplifiers IC1*a* and IC1*b* which are actually integrated into a unit operational amplifier, C-MOS inverters IC2–IC4, diodes D1–D3, double diodes DD1–DD3, capacitors C1 and C2, and resistors R1–R18.

Reviewing the arrangement of the timer circuit TM, the N.C. contact KX1*b* is connected across the terminals 5 and 6 of the timer circuit TM. The terminal 6 is grounded and the terminal 5 is connected to the base of the transistor Q2 through the resistor R11 which is connected through the resistor R10 to a positive terminal of a first DC power source (+12 V). The collector of the transistor Q2 is also connected to a positive terminal of the first DC power source through the resistor R2 and to one of the double diodes DD1 and one of the double diodes DD3. The N.O. contact X32*a* is connected across the terminals 3 and 4 of the timer circuit TM. The terminal 4 is grounded and the terminal 3 is connected to a positive terminal of the first DC power source and to the respective inputs of the inverters IC2 and IC4, the outputs of which are respectively connected to the non-inverting inputs of the OP amplifiers IC1*a* and IC1*b*, respectively through the parallel combination of the resistor R4 and the series combination of the diode D1 and the resistor R3 and through the parallel combination of the series combinations of one of the double diode DD2 and the resistor R12 and of the other of the double diode DD2 and the resistor R13. The non-inverting terminals of the OP amplifiers IC1a and IC1b are respectively connected to the junctions of one of the double diode DD1 and the capacitor C1 and one of the double diode DD3 and the capacitor C2, respectively across the first DC power source, and also connected to the others of the double diode DD1 and DD3. Across the inverting terminal and the output terminal of the OP amplifier IC1*a* the series combination of the resistor R7 and the inverter IC3 is connected while across the inverting terminal and the output terminal the series combination of the resistor R16 and the inverter IC2 is connected. The inverting terminals of the OP amplifiers IC1*a* and IC1*b* are respectively connected to the junctions of the resistors R5 and R6 and the resistors R14 and R15, respectively across the first DC power source. The relay X1 is connected to the collector of the transistor Q1 while the relay X2 is connected to the collector of the transistor Q3, respectively across a second DC power source (+24 V). The diodes D2 and D3 are respectively connected in parallel with the relays X1 and X2. The base of the transistor Q1 is connected to the junction of the resistors R8 which is connected to the output of the OP amplifier IC1*a* and the resistor R9 which is grounded while the base of the transistor Q3 is connected to the junction of the resistors R17 which is connected to the output of the OP amplifier IC1b and the resistor R18 which is grounded. It is to be noted that the first and second DC voltages are developed by the conversion via a DC circuit (not shown) included in the timer circuit TM connected to the terminal 1 and 2.

In operation, while the N.O. contact X32*a* of the relay X3 shown in FIG. 1 is in the open state, namely while the ice making water is not filled up to a predetermined water level so that the water level switch FS is open, the output of the inverter IC2 is at a low level (L), and the capacitor C1 is not charged. Therefore, the non-inverting input of the OP amplifier IC1*a* is higher in level than the inverting input of the same whose output is also at the low level, thereby retaining the non-conducting state of the transistor Q1 in which the relay X1 is not excited. This also applies to the relay X2.

As the water level moves up to a point where the water level switch FS closes, the relay X3 is excited to close the contact X32*a*. Then, the input of the inverter IC2 becomes low so that the output level of the inverter IC2 becomes high (H), thereby initiating the charging of the capacitor C1. At this moment, since the output of the OP amplifier IC1*a* is still at the low level, the output of the inverter IC3 at the high level, whereby the voltage of the inverting input of the OP amplifier IC1*a* is $\frac{2}{3}$ of the power source voltage Vcc (e.g. 12 V as shown) by means of the resistors R5–R7 which have respectively a resistance of about 100 kilo-ohms. Therefore, as the capacitor C1 is charged up to a voltage corresponding to the $(\frac{2}{3})$Vcc, the output of the OP amplifier IC1*a* is changed over to the high level, so that the inverting input is subjected to a voltage level of $(\frac{1}{3})$Vcc due to the output voltage of the inverter IC3 going low and the transistor Q1 is changed to the conduction state to excite the relay X1. This allow the auger motor GM to be driven as mentioned above.

In this case, a time interval required for the switch-over of the output of the OP amplifier IC1*a* from the L level to the H level depends on the time constant defined by the resistor R3 and the capacitor C1, since the resistor R4 has a relatively large resistance. In the embodiment where the resistance R3 has 2.4 kilo-ohms and the capacitor C1 has 150 micro-farads, the above noted switch-over time interval is about 0.4 seconds which is negligibly short. Therefore, it is seen from FIG. 3 that the relay X1 is excited almost simultaneously with the closure of the contact X32*a*.

On the other hand, the capacitor C2 also starts charging through the resistors R1, R12, the inverter IC4 and one of the double diode DD2 by the closure of the contact X32*a*, so that after a fixed time interval as shown by T1 in FIG. 3 the relay X2 is excited to drive the compressor CM as mentioned above. This time interval T1 corresponds to a time constant (about 60 seconds) defined by the resistor R12 (about 330 kilo-ohms) and the capacitor C2 (about 150 micro-farads).

Upon the detection of the ice level by using the ice level switch TH1, the relay X3 is deenergized to open the contact X32*a*, at which time the output of the inverter IC2 again becomes low so that the charge in the capacitor C1 begins to discharge through the resistor R4. This also applies to the discharge of the capacitor C2 through the resistor R13. In the embodiment where for example, the resistor R4 has 620 kilo-ohms, and the resistance R13 has 330 kilo-ohms, time intervals (T2 and T3) from the commencement of the discharge to a point when the inverting input voltage of ($\frac{1}{3}$)Vcc of the OP amplifier IC1*a* and IC1*b* exceeds the level of the non-inverting input or the voltage of the capacitor is set such that T2 (about 60 seconds) is shorter than T3 (about 120 seconds). Therefore, the relay X2 is deenergized about 60 seconds after the contact X32*a* has opened, and about 60 seconds thereafter the relay X1 is deenergized.

From this, it is seen that, if the contact X32*a* is opened and closed for 60 seconds or less, the operations of the relays X1 and X2 are not affected. For this reason the control circuit is not affected by momentary changes in the level of the ice making water i.e. during lowering of the water lever or by the interruption of the water supply for a fixed time interval as shown by T4 in FIG. 3.

The operation of the keep-rely KX when the ice level switch TH2 for backup is actuated is as follows:

Upon the excitation of the keep-relay KX by the closure of the backup switch TH2, the N.C. contact KX1*b* of the relay KX is opened. It is to be noted that the contact KX1*b* is normally closed to non-conduct the transistor Q2, whereby the output thereof does not effect the other parts of the circuit. This causes the transistor Q2 to be conductive so that the charges present in the capacitors C1 and C2 are immediately discharged respectively through the respective ones of the double diodes DD1 and DD3. Therefore, the relays X1 and X2 are both deenergized immediately after the operation of the keep-relay KX, as shown in FIG. 3. Thus, a dangerous condition can be removed quickly.

The feature of the timer circuit TM shown in FIG. 4 resides in that since the charging/discharging circuit of the capacitors C1 and C2 as well as the positive feedback circuit connected to the inverting input of the OP amplifier include C-MOS inverters, the values of the H and L levels have nearly respectively Vcc and the ground level so that the actual values do not deviate from the design values whereby a variation of operating time is quite suppressed.

It is to be noted that in addition to the above, a protector which can be restored manually may be inserted in series with the auger motor GM to deenergize the relay X4 for immediate stoppage of the ice making process so as to preclude a danger of over-load current flowing through the auger motor which damages the ice making mechanism.

Accordingly, in this invention, since the sequential control of an auger motor and a compressor is carried out by the use of a relay circuit and a timer circuit, a secure operation is attained without variation and overload operations while a continuous operation is provided in the case of a short-time interruption of water supply while an idling operation can be precluded in the case of a complete water interruption. Moreover, even in the case of such an abnormal condition, the ice making process can be immediately stopped, advantageously resulting in a safe operation.

It is to be noted that while the present invention has been described with reference to the above embodiments illustrated in the accompanying drawings, it should not be limited to them and may be applied with various modifications thereof without departing from the spirit of the invention.

What we claim is:

1. A control circuit for an auger type ice maker driven by an auger motor and a compressor motor, comprising:

a first means for detecting a predetermined level of ice making water in a water tank;

a second means for detecting a predetermined level of ice in an ice storage hopper;

a relay means which is excited and self-held in response to the detection of said predetermined level of the water by said first means to stop the supply of the water and which is deenergized in response to the detection of said predetermined level of ice by said second means; and, a timer circuit means for developing at the beginning of the ice making cycle a signal for driving said auger motor immediately after the excitation of said relay means and then after a first predetermined time interval a signal for driving said compressor motor and, during the stopping operation, developing a signal for stopping said compressor motor after a second fixed time interval and after the deenergization of said relay means and a signal for stopping said auger motor after a further third fixed time interval and after said compressor motor has stopped.

2. A control circuit for an auger type ice maker as claimed in claim 1, wherein said first means comprises a floating normally open contact which is closed when the level of water exceeds said predetermined level.

3. A control circuit for an auger type ice maker as claimed in claim 1, wherein said second means comprises a normally closed ice level switch.

4. A control circuit for an auger type ice maker as claimed in claim 2, wherein said first means further comprises a second lower floating normally open contact which is closed when the level of water exceeds a second predetermined level which is lower than said predetermined level.

5. A control circuit for an auger type ice maker as claimed in claim 4, wherein said relay means comprises first and second normally open contacts and a normally closed contact, said first normally open contact being serially connected to said lower floating normally open contact, said series combination being connected in parallel with said upper floating normally open contact, said parallel combination being serially connected to said relay means and said ice level switch, said normally close contact of said relay means being serially connected to a water valve and said ice level switch, whereby said second normally open contact of said relay means provides the signals of the excitation and the deenergization of said relay means to said timer circuit means.

6. A control circuit for an auger type ice maker as claimed in claim 4, wherein said timer circuit means includes first and second relays, said first relay having a normally open contact for developing said signals for driving and stopping said auger motor and said second relay having a normally open contact for developing said signals for driving and stopping said compressor motor, said timer circuit means including means for energizing said first relay at the time when said second normally open contact of said relay means is closed and said second relay in said fixed time interval when said second normally open contact of said relay means is closed, and means for deenergizing said second relay in said second fixed time interval when said second normally open contact of said relay means is opened and said first relay in said third fixed time interval after the deenergization of said second relay.

7. A control circuit for an auger type ice maker as claimed in claim 6, wherein said second fixed time interval is preset so as to ignore the opening of said second normally open contact of said relay means for a short time due to the interruption of the supply of water.

8. A control circuit for an auger type ice maker as claimed in claim 7, wherein said timer circuit means includes first and second inverting means responsive to the state of said second normally open contact of said relay means for inverting a reference voltage, first and second charging/discharging means respectively connected to the output of said first and second inverting means respectively with respectively fixed time constants, first and second comparing means for respectively comparing a reference voltage with the charged voltage of said charging/discharging means, and first and second switching means connected to the respective outputs of said first and second comparing means for respectively energizing/deenergizing said first and second relay, the charging time constant of said first charging/discharging means being approximately zero and the discharging time constant of said first charging-/discharging means being longer than that of said second charging/discharging means, said first and second comparing means respectively having inverting means connected across the output and the reference input thereof.

9. A control circuit for an auger type ice maker as claimed in claim 8, wherein all of said inverting means includes a C-MOS IC.

10. A control circuit for an auger type ice maker as claimed in claim 9, further including a second ice level switch for detecting an abnormal ice level condition arising in the failure of said ice level switch, and a keep-relay set by the operation of said second ice level switch and reset by the operation of a push button, said timer circuit means further including means for deenergining said first and second relay at the time when said keep-relay is set.

* * * * *